United States Patent [19]

Mänttäri et al.

[11] 4,395,207

[45] Jul. 26, 1983

[54] GEAR PUMP OR MOTOR WITH BEARING PASSAGE FOR SHAFT LUBRICATION

[75] Inventors: Erkki Mänttäri; Matti Korpinen, both of Jyväskylä, Finland

[73] Assignee: Valmet Oy, Finland

[21] Appl. No.: 197,471

[22] Filed: Oct. 16, 1980

[30] Foreign Application Priority Data

Oct. 22, 1979 [FI] Finland ..... 793282

[51] Int. Cl.[3] ..... F03C 2/08; F04C 2/18; F04C 15/00

[52] U.S. Cl. ..... 418/102; 418/131

[58] Field of Search ..... 418/102, 131–135

[56] References Cited

U.S. PATENT DOCUMENTS 3,063,378 11/1962 Hart ..... 418/102

FOREIGN PATENT DOCUMENTS 1941641 2/1971 Fed. Rep. of Germany ..... 418/102

1382426 1/1975 United Kingdom ..... 418/102

*Primary Examiner*—John J. Vrablik

*Attorney, Agent, or Firm*—Steinberg & Raskin

[57] ABSTRACT

Gear pump and motor apparatus adapted to operate both as a pump and as a motor include two meshing gears whose shafts are supported in a housing chamber by respective bearing sleeves whose end faces sealingly engage the end faces of the respective gears. An oil supply passage is formed in each of the bearing sleeves in a region diametrically opposed to flat surface portions formed on the outer peripheral surface of the bearing sleeves and near a central plane which passes through the axes of cylindrical chamber portions in which the gears are situated. Oil leaking from the pump-/motor chamber is directed into spaces defined between the peripheral surfaces of the bearing sleeves and the respective chamber portions through the oil supply passages into the bearing sleeve openings to lubricate the gear shafts which are received therein. The ratio of the length to the diameter of each of the oil supply passages is less than or equal to about 10.

5 Claims, 2 Drawing Figures

GEAR PUMP OR MOTOR WITH BEARING PASSAGE FOR SHAFT LUBRICATION

BACKGROUND OF THE INVENTION

The present invention relates to gear pump and motor apparatus adapted to operate alternatively either as a pump or as a motor of the type which includes a pair of meshing gears whose shafts are respectively supported in a housing by separate bearing sleeves and whose inner faces sealingly engage the faces of the gears by means of oil pressure which urge the bearing sleeves in an axial direction so as to provide a tight sealing engagement.

With respect to the state of the art of such gear pump and motor apparatus, reference is made to British Pat. Publication No. 1,067,552 and German Application Publication (OS) No. 1,703,180.

Further regarding the state of the art, reference is also made to applicant's Finnish Pat. Nos. 51,992 and 51,993. The gear pump/motor disclosed in Finnish Pat. No. 51,992 includes features whereby tilting of the bearing sleeves under varying operating conditions is prevented. More particularly, in this gear pump/motor, the elevated pressure in the gear chamber is directed from an axial sleeve equilibrium field to partial pressure fields defined by sealing members through pressure compensating openings located in the bearing sleeves in the middle of the region where pressure increases during average operating conditions so that in this manner tilting of the bearing sleeves under conditions which deviate from the normal is eliminated.

It is of course necessary in gear pump/motor apparatus of the type described above to provide lubrication between the bearing sleeves and the shaft of the respective gear received therein. Generally, in conventional arrangements, such lubrication is accomplished through the application of a vacuum or by means of oil passages directed from the inlet side of the chamber into the bearing sleeves. However, such conventional arrangements are not entirely satisfactory when used in connection with a gear pump/motor which rotates in two directions since the passages must necessarily be located in an asymmetric fashion on the face surfaces of the bearing sleeves.

For maximum total efficiency, a texlon coating is provided on the inner face surface of each bearing sleeve which reduces oil leakage from the gear housing to the gear shaft located within the bearing sleeve.

Another arrangement has been suggested for providing a controlled oil leakage from the gear chamber to the gear shaft journal within the bearing sleeve. Thus, the curvature of the gear teeth directed towards the gear face has been increased in order to promote such oil leakage to facilitate lubrication. However, this technique has not proved satisfactory for a variety of reasons. More particularly, due to the difference in curvature in the gear teeth, the pressure unavoidably is distributed on the side of the gear teeth having the increased curvature. Thus, an uneven pressure distribution acts on the gears giving rise to a differential pressure which tends to move the gears against the opposing sleeve bearing resulting in a higher leakage at the end face of the gear facing the sides of the teeth having the increased curvature and the possibility of seizing of the bearing sleeve face at the side opposing the gear teeth having lesser curvature.

It has also been proposed in connection with providing a controlled leakage of oil from the gear pump/motor housing to the gear shaft journal to provide a groove in the central neck region of the face of the bearing sleeve so that oil leaking from the housing passes between the gear and face and the mating end face of the bearing sleeve. However, such arrangements have the disadvantage that the groove must be extremely small and as the face of the bearing sleeve wears during operation, the groove becomes filled with material which obstructs the flow of oil to the gear shaft journal.

Furthermore, difficulties have arisen in drilling bores or passages having a small diameter to the bearing sleeve from the pressure side of the pump/motor in order to provide a controlled leakage directly to the bearing sleeve. For example, in order to provide a suitable leakage flow, namely about 1 liter per minute, through a passage having a length of 18.5 mm, the bore necessarily requires a diameter of about 0.25 mm. Thus, the length/diameter ratio in this example is 74. However, in practice, it has been found that the highest recommended length/diameter ratio is about 10. Further, the location of such a passage or bore is unsatisfactory especially in connection with combination pump/motor arrangements which rotate in two directions wherein such a provision is not possible.

SUMMARY OF THE INVENTION

Accordingly, one object of the present invention is to provide new and improved gear pump and motor apparatus which overcome the disadvantages discussed above.

More particularly, it is an object of the present invention to provide new and improved gear pump and motor apparatus wherein lubrication of the gear shaft journals within respective bearing sleeves is accomplished in an efficient manner regardless of the direction of rotation of the pump/motor and which eliminates the manufacturing problems encountered in conventional arrangements discussed above.

Briefly, in accordance with the present invention, these and other objects are attained by providing gear pump/motor apparatus including a housing having a chamber defined therein including a pair of superimposed substantially cylindrical portions intercommunicating with each other, a pair of meshing toothed gears situated in respective chamber portions, a pair of bearing sleeves mounted in respective portions of the housing chamber, the gear shafts being received in the central opening of respective bearing sleeves and wherein the bearing sleeves are formed with respective flat portions which engage each other. According to the invention, an oil supply passage is formed in each bearing sleeve extending between the peripheral surface and the central opening thereof in a region of a plane which passes through the axes of the cylindrical chamber portions and which is diametrically opposed to the flat surface portions of the bearing sleeves. In this manner, oil leaking from the chamber is directed through the spaces defined between the bearing sleeves and the chamber portions through the oil supply passages into the bearing sleeve openings to lubricate the gear shafts which are received therein. The length/diameter ratio of the oil supply passages is less than or equal to about 10.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DETAILED DESCRIPTION OF THE PREFERRED EMBODIMENTS

Figure 2:
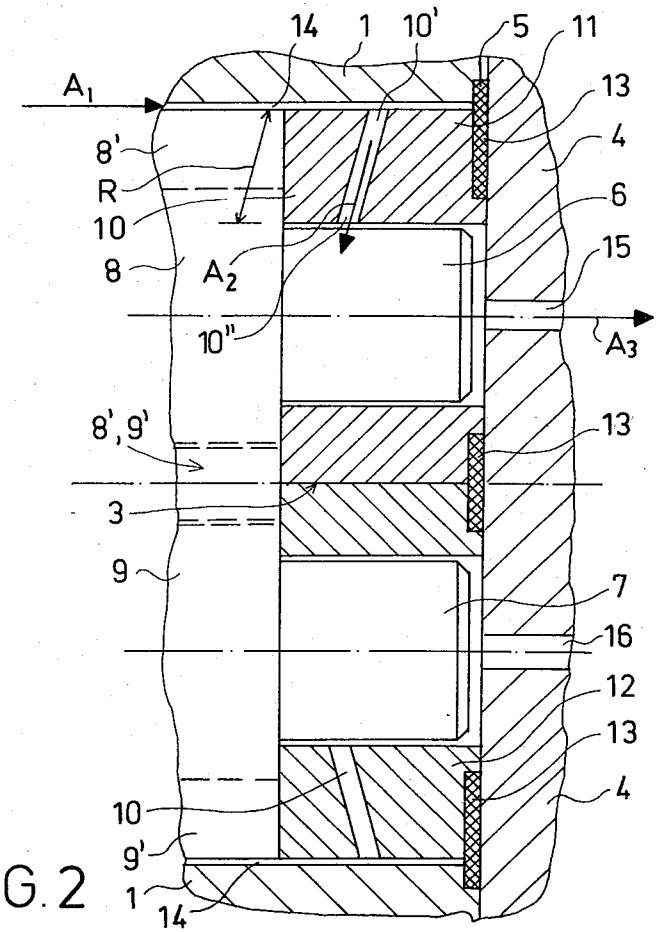
FIG. 2 is a section view taken along line II—II of FIG. 1.

Referring now to the drawings wherein like reference characters designate identical or corresponding parts throughout the several views, the gear pump/motor apparatus of the present invention includes a housing 1 having a chamber 2 formed therein and opening at both sides of the housing 1, the chamber 2 being sealed by means of a fixed flange at one end (not shown) and an end flange 4 at the other end. The chamber 2 comprises a pair of superimposed substantially cylindrical portions intercommunicating with each other as seen in FIG. 1.

A pair of parallely extending toothed gears 8 and 9 having meshing toothed sections 8' and 9' are situated in respective portions of the housing chamber 2. Axial shafts 6 and 7 are fixed to and extend from the end faces of gears 8 and 9, respectively and a pair of bearing sleeves 11 and 12 are mounted in respective portions of the housing chamber 2 in which the shafts or axles 6 and 7 of gears 8 and 9 are journalled. Similar axles and bearing sleeves are provided at the other ends of gears 6 and 7 and are not shown in the figures. Axles 6 and 7 and respective gears 8 and 9 are formed of any suitable solid material.

Each of the bearing sleeves 11 and 12 includes a body having an inner face surface adapted to engage the opposed end face surface of the respective gear under pressure, the bearing sleeves 11 and 12 being mounted for axial movement under pressure within the housing chamber 2. The bearing sleeve body also includes an outer face surface, an outer peripheral surface and a central opening which receives the shaft of the respective one of the gears. Furthermore, the outer peripheral surfaces of the bearing sleeve bodies are each formed with a respective flat portion 3, which flat portions engage each other as seen in the figures in the region where the cylindrical chamber portions intercommunicate with each other. The housing chamber and bearing sleeves are dimensioned such that the distance between the centers of curvature of the bearing sleeves is greater than the distance between the centers of curvature of the substantially cylindrical housing portions. The end flange 4 and outer face surfaces of bearing sleeves 11 and 12 sealingly engage each other by means of a gasket 13 having a rectangular cross section located in appropriate grooves formed in the bearing sleeves and housing 1. In order to provide a tight seal, the thickness of gasket 13 is somewhat greater than the height of grooves 5 in which the gasket is seated. In this manner, external leakage of oil from the pump/motor chamber is prevented.

Figure 1:
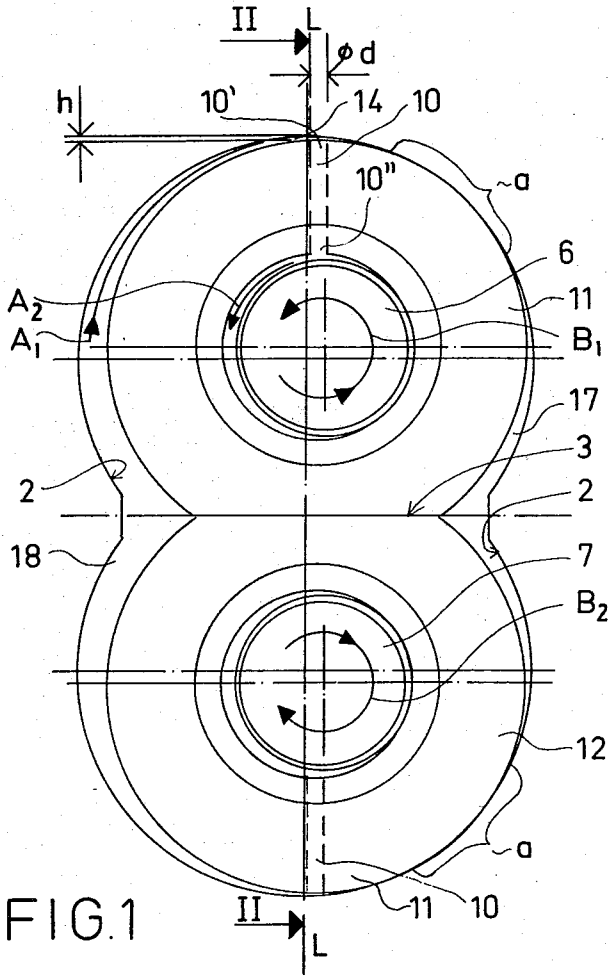
FIG. 1 is a transverse end view of the gear pump/motor apparatus of the present invention in schematic form and illustrating the manner in which the bearing sleeves are mounted in the housing chamber.

Referring to FIG. 1, the inlet side of the pump is designated 17 while the outlet side of the pump is designated 18. The cylindrical portions of chamber 2 and bearing sleeves 11 and 12 are appropriately configured so that the pressure differential which exists between the inlet and outlet sides 17 and 18 of the pump result in situating the bearing sleeves 11 and 12 such that a portion of the outer peripheral surfaces thereof sealingly engage a portion of the inner surfaces of the cylindrical chamber portions along areas designated a. In this manner a clearance h is defined between the peripheral surface of the bearing sleeves 11 and 12 and the cylindrical surfaces of the chamber portions in the region of a plane L—L which passes through the axes of the cylindrical chamber portions. Further, a space is defined between the outer peripheral surfaces of the bearing sleeves 11 and 12 and the respective portions of the housing chamber, the spaces tapering or becoming narrower as the same approach the region of clearance h, terminating at a small slot 14 at this region.

According to the present invention, each bearing sleeve is provided with an oil supply passage or bore 10 which extends between the peripheral surface and the central opening of the respective bearing sleeves in the region of the plane L—L which passes through the axes of the cylindrical chamber portions, which central plane is substantially the same plane as that which passes through the axes of the bearing sleeves 11 and 12. Further, in the illustrated preferred embodiment, the oil supply passages 10 are formed in the region of bearing sleeves 11 and 12 which are diametrically opposed to the flat surface portions 3 thereof.

The length/diameter ratio of passages 10, i.e., R/d, is less than or equal to about 10 whereby the manufacture of such passages is relatively simplified.

The slots 14 described above function to choke the oil flow during operation of the pump/motor apparatus. The amount of oil leaking from the housing chamber into the passage 10 can be obtained from the following relationship:

$$\dot{Q} = \frac{\pi h^3}{6\eta} \cdot \frac{\Delta p}{\ln\left(\frac{r_2}{r_1}\right)}$$

where

Q = amount of oil leaking to bearing through passage 10 h = clearance between bearing sleeve and pump chamber in the region of passage 10

P = difference between the working pressure and the pressure of oil leaking into passage 10

$\eta$ = absolute viscosity of oil $r_1$ = radius of passage 10

$r_2$ = radius of the choking section 14

Since the quantity of lubricating oil required to be supplied to the gear shafts is generally about 1% of the pump output, the required clearance h between the bearing sleeve and the pump chamber in the region of passage 10 can be calculated by the above formula.

Again referring to FIGS. 1 and 2 wherein the various clearances have been exaggerated for purposes of clarity, arrows $A_1$ and $A_2$ illustrate the flow of oil leaking from the chamber 2 through space 14 and into passages 10 so as to lubricate the shafts 6 and 7 of gears 8 and 9. As seen in FIG. 2, openings 15 and 16 are formed through end flange 4 coaxial with shafts 6 and 7, respectively, for discharge of the lubricating oil in a known manner.

By locating the lubricating oil passages 10 substantially in the region of the plane L—L which passes through the axes of the cylindrical pump chamber portions as described above in accordance with the present invention, the shafts 6 and 7 of gears 8 and 9 are provided with essentially the same lubrication regardless of the direction of rotation of the pump/motor. In other words, the central openings of the bearing sleeves will be similarly lubricated whether the apparatus be utilized as a pump or as a motor. Thus, if it be assumed that the apparatus illustrated in FIG. 1 is shown during operation as a pump, if the same were utilized as a motor, the direction of rotation of the gear shafts would be opposite to that designated by the arrows $B_1$ and $B_2$ with a reversal of the inlet and outlet sides of the pump. Consequently, the pressure differential would be similarly reversed with the bearing sleeves 11 and 12 being displaced so that the areas a would then be located on the other side of plane L—L. Accordingly, the spaces defined between the peripheral outer surfaces of the bearing sleeves and the cylindrical chamber portions would exist on the opposite side of plane L—L than that shown in FIG. 1 with the choking slot 14 similarly displaced. The flow of oil leaking from the pump chamber would, however, follow the analogous course through the space, slot 14 and passages 10.

By providing the oil supply passages 10 with the dimensions described above, the present invention effectively eliminates the manufacturing and lubricating problems encountered in the use of conventional pump-/motors of similar type.

Still referring to FIGS. 1 and 2, when viewing the apparatus in an axial direction, i.e., in a cross section transverse to the axis of the bearing sleeves, the oil supply passages 10 extend substantially radially with respect to each respective bearing sleeve. However, when the apparatus is viewed in its longitudinal cross section such as illustrated in FIG. 2, it is seen that the outer ends 10' of the oil supply passages 10 open onto a substantially axially central region of the peripheral surface of the respective bearing sleeves whereas the inner ends 10'' of the passages 10 open into the central opening of the bearing sleeve at a region closer to the end face of the respective gear then to the outer end face of the bearing sleeve. This particular configuration of the oil supply passages facilitates the flow of the lubricating oil to the butt sections of shafts 6 and 7.

It is of course possible to utilize two or more oil supply passages in side by side fashion in lieu of only a single passage as shown in each bearing sleeve within the scope of the present invention. In such case, the manufacture of the passages 10 is not difficult since the diameter d of such passages in the case of two or more holes will be smaller thereby improving the ratio R/d.

Obviously, numerous modifications and variations of the present invention are possible in the light of the above teachings. It is therefore to be understood that within the scope of the claims appended hereto, the invention may be practiced otherwise than as specifically described herein.

What is claimed is:

1. Gear pump and motor apparatus adapted to operate alternatively either as a pump or as a motor, comprising: a housing having a chamber defined therein, said chamber including a pair of superimposed substantially cylindrical portions defined by respective substantially cylindrical inwardly facing surfaces, said chamber portions intercommunicating with each other; a pair of parallely extending toothed gears situated in said housing chamber in meshing engagement with each other, each of said gears having an axial shaft fixed to and extending from at least one of its ends; a pair of bearing sleeves, each bearing sleeve being mounted in a respective chamber portion of said housing chamber and including a body having an inner face surface adapted to normally sealingly engage the end face of a respective gear, an opposed outer face surface, a substantially cylindrical outer peripheral surface having a diameter smaller than the diameter of said inwardly facing cylindrical surface of a respective cylindrical chamber portion and defining a space between it and said inwardly facing surface of the respective cylindrical chamber portion of said housing chamber, and a central opening which receives and supports a shaft of a respective one of said gears for mounting the latter in a respective portion of said housing chamber, and an oil supply bore formed through each bearing sleeve substantially in the plane which passes through the axes of said chamber portions, each bore opening at one end into the space defined by the outer peripheral surface of a respective bearing sleeve and the inwardly facing surface of a respective chamber portion and opening at its other end into the central opening of said bearing sleeve, and wherein the ratio of the length to the diameter of each of said oil supply bores being less than or equal to about 10, whereby oil is directed from said spaces defined between the peripheral surfaces of the bearing sleeves and the inwardly facing surfaces of the respective chamber portions through said bores into said bearing sleeve openings to lubricate the gear shaft received therein.

2. The combination of claim 1 wherein in a cross section transverse to the axis of said bearing sleeves, each of said oil supply bores extends substantially radially with respect to a respective bearing sleeve.

3. The combination of claim 1 wherein said outer peripheral surfaces of said bearing sleeve bodies are formed with respective flat portions which engage each other in the region where said cylindrical chamber portions intercommunicate and wherein said oil supply bores formed in said bearing sleeves are formed in a region which is diametrically opposed to said flat surface portions.

4. The combination of claim 1 wherein in a longitudinal cross section of said apparatus relative to the axes of said sleeve bearings, an outer end of each oil supply bores opens onto a substantially axially central region of the peripheral surface of a respective bearing while an inner end of said bores opens into the central opening of said bearing sleeve at a region closer to said end face of a respective gear than to said outer end face of said bearing sleeve.

5. The combination of claim 4 wherein in a cross section transverse to the axes of said bearing sleeves, each of said oil supply bores extends substantially radially with respect to a respective bearing sleeve.

* * * * *